US005095594A

United States Patent [19]

Marosy

[11] Patent Number: 5,095,594

[45] Date of Patent: Mar. 17, 1992

[54] COUPLING

[76] Inventor: Andre Marosy, 16249 Hilton, Southfield, Mich. 48075

[21] Appl. No.: 689,489

[22] Filed: Apr. 23, 1991

[51] Int. Cl.[5] ..... A44B 17/00

[52] U.S. Cl. ..... 24/597; 24/591

[58] Field of Search ..... 24/597, 590, 591, 616, 24/653, 701

[56] References Cited

U.S. PATENT DOCUMENTS 3,286,316 11/1966 Marosy ..... 24/597
3,487,512 1/1970 Marosy .
3,540,087 11/1970 Marosy .
3,540,091 11/1970 Marosy ..... 24/597
3,675,499 7/1972 Marosy .
4,184,232 1/1980 Marosy .
4,236,283 12/1980 Marosy .

*Primary Examiner*—Victor N. Sakran
*Attorney, Agent, or Firm*—Charles W. Chandler

[57] ABSTRACT

A coupling comprising a male and a female member. The female member includes a spring-biased receiving member biased toward a slotted and apertured end plate. The male member (22) includes an inverse V-shaped cam surface which, upon insertion into the slot, engages opposed sides of the receiving member. The inward motion of the male member causes the receiving member to rotate against the action of a spring. Further inward motion of the male member, past the slot, permits the receiving member to spring back to its original orientation carrying with it the male member to a latched position. In the latched position, the male member resides at approximately 90 degrees with respect to the slot.

12 Claims, 1 Drawing Sheet

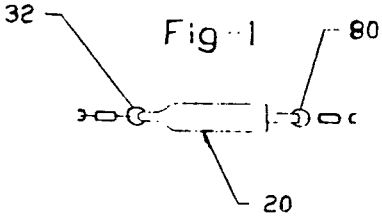
Fig-1
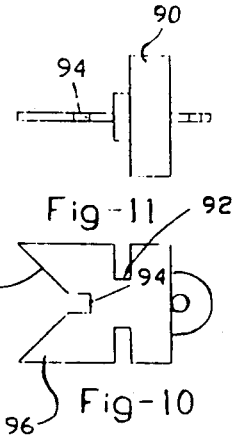
Fig-11
Fig-10
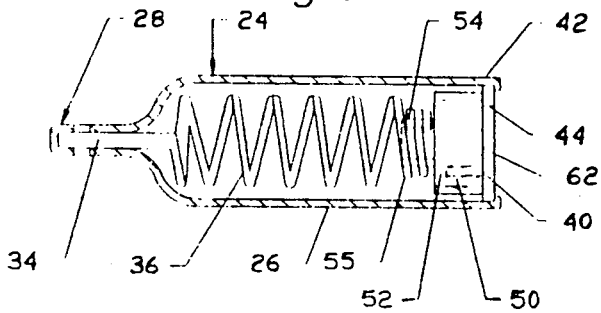
Fig-2
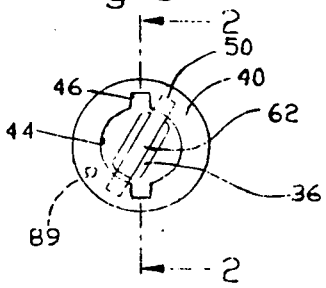
Fig-3
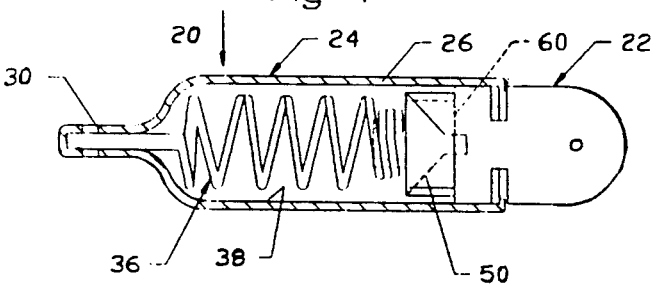
Fig-4
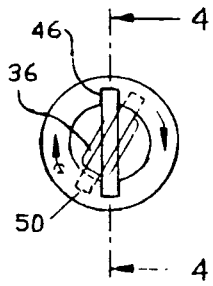
Fig-5
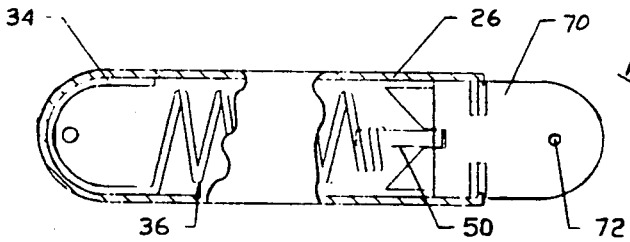
Fig-6
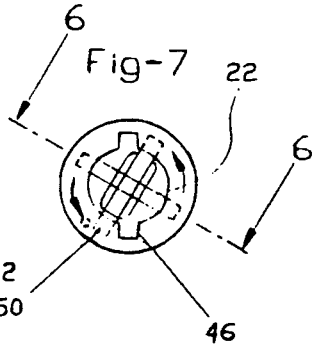
Fig-7
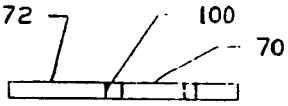
Fig-9
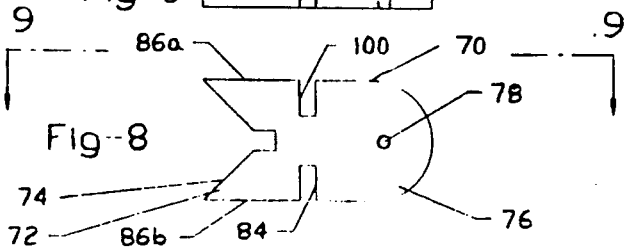
Fig-8

COUPLING

BACKGROUND AND SUMMARY OF THE INVENTION

The invention relates to a quick connect and disconnect device particularly well suited for coupling chains and cables for jewelry and the like.

Prior couplings have included spring clasps, and split rings with spring biased pins. These couplings have proved to be difficult to open and close because of their cumbersome nature and complicated design. An improvement to these couplings can be seen in my prior U.S. Pat. Nos. 3,286,316, issued Nov. 22, 1966; 3,487,512, issued Jan. 6, 1970; 3,540,087, issued Nov. 17, 1970; 3,675,499, issued July 11, 1972; 4,184,232, issued Jan. 22, 1980; and 4,236,283 issued Dec. 2, 1980. In my U.S. Pat. No. 4,184,232 I proposed a coupling comprising a male member having a T-shaped element adapted to be introduced through a slotted aperture in an end plate of the female member. A pair of flat springs, disposed in the female member, engage and resiliently rotate the male member away from the slot, as the male member is being inserted in the slot.

The present invention is an improvement which permits greater ease in coupling and decoupling, requires fewer parts, and provides improved operation. The device should be more easily and economically manufactured.

It is an object of the present invention to provide a coupling which locks simply by pushing the male portion and female portion together. A further object of the present invention is to reduce the cost of manufacturing the coupling. Another object of the present invention is to provide a coupling which is easy to use and which unlocks by simply rotating the two members relative to each other. The two members disengage by virtue of an outward bias provided by expansion of an internal spring member.

Accordingly, the invention comprises a coupling having a male and a female member. The female member comprises a hollow housing closed at one end by an end plate. The end plate has a centrally disposed circular aperture. A diametrically disposed slot extends beyond the border of the circular aperture.

A receiving member is disposed within the housing behind the end plate. Spring means initially bias the receiving member at an angular orientation relative to the slot, and towards the end plate. The spring plate means permit the receiving member to be moved inwardly and rotated from its initial angular orientation.

One end of the male member has a handle adapted to be grasped by the user. The opposite end has a shape receivable in the slot. The inner end of the male member has a cam edge for engaging opposite ends of the receiving member's end edge. As the male member is inserted in the slot, the cam edge displaces the receiving member away from the end plate until the male member reaches a position in which the spring means rotates the male member to a latched position. Such rotation carries the male member out of alignment with the slot. The male member is uncoupled by rotating it into alignment with the slot, then pulling it from the housing. Other objects and purposes of the invention will be clear from the following detailed description of the drawings.

BRIEF DESCRIPTION OF THE DRAWINGS

FIG. 1 illustrates a coupling constructed in accordance with the present invention linking ends of a cable or chain.

FIG. 2 illustrates a cross sectional view of a female coupling member, as seen along lines 2—2 of FIG. 3.

FIG. 3 illustrates a right end view of a portion of FIG. 2.

FIG. 4 is a sectional view illustrating the male and female portions of the coupling in partial coupling engagement, as seen along lines 4—4 of FIG. 5.

FIG. 5 is another end view of the components illustrated in FIG. 4.

FIG. 6 illustrates the coupling of the present invention in its engaged or latched position, as seen along lines 6—6 of FIG. 7.

FIG. 7 illustrates an end view similar to FIG. 4, but with the male member rotated to the latched position.

FIG. 8 is a plan view of the male member.

FIG. 9 is a view of the male member as seen along lines 9—9 of FIG. 8.

FIGS. 10 and 11 illustrate an alternate embodiment of the male coupling member.

DETAILED DESCRIPTION OF THE DRAWINGS

The figures show a coupling 20 fabricated in accordance with the present invention. Coupling 20 comprises a plate-like male member 22 and female member 24.

Female member 24 comprises a generally cylindrical housing 26 including a somewhat flattened end 28 having an aperture 30 for receiving an end link 32 (see FIG. 1) of a chain or cable. Flattened end 30 also secures the end 34 of helical spring 36. Helical spring 36 extends longitudinally within a cavity 38 formed within the interior of the housing 26. Spring 36 is disposed to move axially and radially within housing 26.

Female member 24 includes an end plate 40 (see FIG. 2) which may be secured to the housing by soldering or crimping of the rim of the open end 42 of the housing about the outer edge of end plate 40. End plate 40 has a substantially flat construction and includes a centrally disposed aperture 44 provided with a diametrically extending slot 46.

Receiving member 50 is positioned within cavity 38. The receiving member comprises a substantially rectangular plate portion 52 and a smaller base portion 54 extending inwardly from plate portion 52.

End 55 of spring 36 is secured about base portion 54 of receiving member 50. In its extended position, spring 36 biases the end edge 62 of receiving member 50 outwardly against end plate 40. In this condition, the receiving member is oriented at an angle relative to slot 46.

FIG. 3 is an end view of female member 24 illustrating the relationship, in its unmated condition, of receiving member 50 relative to slot 46.

Male member 22 comprises a first portion or handle 70, and a second portion or activating end 72. The rear of handle 70 is flat at 76, and includes an aperture 78 for receiving end link 80 of a chain or cable. End 72 comprises a substantially flat key or tongue-like structure having a V-shaped pair of cam surfaces 82 formed at end 74. In the embodiment shown in FIGS. 4 and 8, the cam surfaces are in the form of a concave V-shaped element. Other concave or cam surfaces are within the scope of the present invention.

Activating end 72 is connected to the first portion or turning end 70 by a narrowed base portion 84 having notch 100 therebetween.

Male member 22 is shown in isolation in FIGS. 8 and 9. Member 22 is flat, having a thickness approximately equal to the thickness of receiving member 50. FIG. 8 illustrates sides 86A and 86B substantially parallel such that the activating end is receivable in slot 46.

In use, male member 22 is inserted into female member 24 through slot 46. The diameter of activating end 72 is slightly less than the diameter of slot 46.

FIGS. 4 and 5 illustrate male and female members 22 and 24, respectively, in a condition where the male member has been almost fully inserted into female member 24. To achieve this condition, activating end 72 has been received through slot 46 and pushed inwardly such that the inverted V-shaped cam surfaces 82 engage opposite sides of end edge 62 of receiving member 50. This diametrical contact cams the receiving member in a clockwise manner thereby torquing spring 36. The inward motion of the male member also compresses helical spring 36. This compression of the helical spring also causes a slight further rotation of spring 36. This clockwise rotation of receiving member 50 and spring 36 as the male member is inserted within female member 24, is diagrammatically shown in FIG. 5. The compression of the spring 36 and turning of the receiving member continues as side surfaces 86A and 86B are slid through and in contact with the walls of slot 46.

Further inward motion of male member 22 causes activating end 72 to be fully received within cavity 38 inward of the end plate (see FIG. 6). In this position, base 84 is positioned within end plate 40, and notch 100 straddles the walls of end plate 40. Recalling that the spring 36 has been compressed and rotated, the restoring torque of the compressed spring is no longer inhibited by the interaction of sides 86 of activating end 72 and slot 46. Spring 36 and receiving member 50 snap back toward their angular position shown in FIG. 3. The spring torque exerted by the receiving member on the inverted V-shaped cam surfaces 82 rotate male member 22 about 90 degrees relative to receiving member 50, achieving a latched orientation as shown in FIG. 7. The male member is also rotated away from slot 46. In such latched position, receiving member 50 and activating end 72 are substantially at right angles to one another. Spring 36 outwardly biases notch 88 against the end plate, preventing male member 22 from rotating.

Stop 89 mounted on the inside of end plate 40, limits rotation of the male member about 90 degrees in the counterclockwise direction from the male member's position as it is being received in the slot.

As shown in FIG. 8, the diameter of handle end 70 is substantially equal to the diameter of activating end 72. The diameter of handle end 70 may be larger than the diameter of slot 46. Configured in this manner, the increased diameter of handle end 70 will automatically stop, i.e. establish the maximum inward motion of the male member.

FIGS. 10 and 11 show an alternative embodiment of the male member. Handle 90 is cylindrical, having a diameter slightly larger than both activation end 72 and slot 46. In addition, base portion 92 is also cylindrical in shape having a diameter slightly less than the diameter of aperture 44. Further, the inverted V-shaped cam surfaces 93 are formed with a rectangular slot 94. The width of the slot is slightly greater than the thickness of receiving member 50. It has been found that during the final insertion of the male member, the interaction of receiving member 50 with activation end 96 is enhanced yielding a more positive coupling action and resulting twisting motion of the male member to its latched configuration.

In order to uncouple the male and female members, the two members are manually rotated relative to one another about their longitudinal axes until the male member is oriented parallel with slot 46. In this position, the previously compressed helical spring 36 automatically expands to its uncompressed condition and forces the male member out through slot 46.

Many changes and modifications in the above described embodiment of the invention can be carried out without departing from the scope thereof. Accordingly, the scope is intended to be limited only by the scope of the appended claims.

Having described my invention, I claim:

1. A coupling (20) comprising:

a male member (22) and a female member (24), the female member (24) comprising a hollow housing (26) closed at one housing end (42) by an end plate (40), the housing (26) and end plate (40) cooperating to enclose a cavity (38) therein;

the end plate (40) comprising a centrally disposed circular aperture (44) and a diametrically disposed slot (46) positioned about the circular aperture (44);

a receiving member (50) disposed within the housing (26) in an initial angular position;

spring means (36) secured to the receiving member (50) for initially maintaining an end (62) of the receiving member at said angular position relative to the slot (46), for biasing the receiving member (50) outwardly towards the end plate (40), for permitting the receiving member (50) to be moved inwardly and rotated from its initial axial and angular positions and for generating a restoring torque on the receiving member (50) urging same toward its initial axial and angular position;

the male member (22) comprising a handle portion (70) adapted to be grasped by a user thereof; a second portion (72) having a shape conformal with that of the slot (46) to permit the second end (72) to be received within the slot, the second portion (72) including an outer end (76) and an inner end (74), such inner end defining convex engagement cam surface means (82) for engaging diametrically opposing edges on the receiving member's end (62) as the male member is inserted in the slot for displacing the receiving member (50) away from the end plate (40) and for rotating the receiving member (50) from said initial angular position in a manner twisting the spring means (36) against a restoring torque, wherein after the second portion (72) has been inserted beyond the end plate, the spring means restoring torque causes the receiving member to rotate the male member (22) to a latched position, such rotation carrying the second portion (72) out of alignment with the slot (46).

2. The coupling (20) as defined in claim 1, wherein the cam surface means (82) comprises a pair of spaced, opposed cam surfaces in a V-shaped configuration.

3. The coupling (20) as defined in claim 1 wherein the cam surface means is an inverted V-like shape having a notch (94) at its inner most portion, the notch being conformal in shape to the end (62) of the receiving member.

4. The coupling (20) as defined in claim 3, wherein the receiving member is substantially rectangular in shape and wherein the notch is also rectangular.

5. The coupling (20) as defined in claim 1, wherein the spring means (36) is a helical spring.

6. The coupling (20) as defined in claim 5, wherein an inner end (34) of the spring means is connected to the end (28) of the housing (26).

7. The coupling (20) as defined in claim 1 wherein the male member (22) has a second notch (100) between said handle portion (70) and the second portion (72).

8. The coupling (20) as defined in claim 7, wherein the width of the second notch is slightly wider than the thickness of the end plate (40).

9. The coupling (20) as defined in claim 7, wherein the central aperture is circular, and the base portion (84) is cylindrical having a diameter slightly smaller than the diameter of the central aperture.

10. The coupling (20) as defined in claim 9, wherein the diameter of the first portion (70) is larger than the diameter of the slot (46).

11. The coupling (20) as defined in claim 10, wherein the handle portion (70) has a cylindrical shape.

12. The coupling (20) as defined in claim 1, further comprising means for fastening the male and female members to a chain or cable.

* * * * *